US005240369A

United States Patent [19]

Voss et al.

[11] Patent Number: 5,240,369

[45] Date of Patent: Aug. 31, 1993

[54] APPARATUS FOR STACKING SHEETS

[75] Inventors: Peter Voss, Jüchen; Ralf Zehl, Erkrath; Ernst Claassen, Goch, all of Fed. Rep. of Germany

[73] Assignee: Jagenberg Aktiengesellschaft, Dusseldorf, Fed. Rep. of Germany

[21] Appl. No.: 762,844

[22] Filed: Sep. 20, 1991

[30] Foreign Application Priority Data

Sep. 21, 1990 [DE] Fed. Rep. of Germany ..... 4029919

[51] Int. Cl.[5] ..... B65H 1/26

[52] U.S. Cl. ..... 414/790.8; 414/927

[58] Field of Search ..... 414/929, 790.8, 927, 414/924; 209/604

[56] References Cited

U.S. PATENT DOCUMENTS

| | | | |
|---|---|---|---|
| 4,111,411 | 9/1978 | Graves et al. | 414/790.8 |
| 4,269,556 | 5/1981 | Martini | 414/790.8 |
| 4,512,701 | 4/1985 | Foust et al. | 414/927 |
| 4,799,847 | 1/1989 | Bodewein | 414/790.8 |

FOREIGN PATENT DOCUMENTS

| | | | |
|---|---|---|---|
| 2410775 | 9/1975 | Fed. Rep. of Germany | 209/604 |
| 2751489 | 2/1979 | Fed. Rep. of Germany | 414/790.8 |
| 3136950 | 10/1982 | Fed. Rep. of Germany | 414/790.8 |
| 3739194 | 4/1990 | Fed. Rep. of Germany . | |

*Primary Examiner*—Michael S. Huppert
*Assistant Examiner*—Gregory A. Morse
*Attorney, Agent, or Firm*—Herbert Dubno

[57] ABSTRACT

A moveable skid is provided to sense the height of a pallet fed to a raisable and lowerable platform. The skid determines the height of the pallet before it is fed to a raisable and lowerable platform of a sheet stacking apparatus so that the position of the pallet below an intermediate stacking platform can be determined during the pallet change. This prevents adverse effects by nondetrimental projections above the surface of the pallet and prevents an excessive drop of the intermediate stack as it is transferred to the pallet.

10 Claims, 3 Drawing Sheets

APPARATUS FOR STACKING SHEETS

FIELD OF THE INVENTION

Our present invention relates to an apparatus for stacking sheets, especially paper or cardboard sheets, on a pallet. More particularly, the invention relates to an apparatus of the type in which a succession of paper sheets which may or may not be folded and can include signatures, generally of paper, paper board or cardboard, is fed to an upright support upon which a pallet-carrying platform is vertically displaceable. The invention is especially related to a system of that type in which it is important to determine the height of the pallet to be disposed upon the pallet-carrying platform so that the pallet can be positioned to receive a stack of sheets temporarily disposed on an auxiliary platform and formed thereon when pallet replacement is in progress.

BACKGROUND OF THE INVENTION

In the handling of paper, paper board, or cardboard, stacking apparatus of the aforedescribed type can be provided in which sheets, e.g. individual sheets, folded sheets, groups or collections of sheets, signatures or the like, for example formed by a transverse cutting or slicing machine, are continuously deposited upon a pallet so as to form a stack thereon. The pallet and the stack can be wrapped and, in general, the pallet is used for the convenient transport and storage of the stack of sheets.

To maintain the height of the drop of the sheets during the deposition thereof on the stack more or less constant, the pallet is provided On a raisable and lowerable pallet-receiving platform which can be raised to a level below the location at which a conveyor or feeder delivers the successive sheets, and then continuously or gradually lowered as the height of the stack increases.

German Patent 37 39 194 discloses a stacking apparatus of this type in which, during the replacement of the pallet on the pallet-receiving platform, e.g. when a stacking is complete and the loaded pallet is to be exchanged for an empty pallet, an auxiliary stacking platform is substituted temporarily for the pallet-receiving platform and collects the sheets to form a temporary stack, thereby preventing the sheets from falling in an uncontrolled manner from the delivery device and eliminating the need for cutting off the continuous feeding of the delivery device and thereby limiting the operating speed of the apparatus.

While the stack is formed on the auxiliary platform, therefore, the pallet-receiving platform can be lowered to allow the completed stack and its pallet to be transported away and a new empty pallet to be placed upon the pallet-receiving platform. The new pallet together with the pallet-receiving platform is then raised to a location just below the auxiliary platform and the temporary stack is transferred to the new pallet on the pallet-receiving platform concurrently with a retraction of the auxiliary platform.

To minimize the drop of the temporary stack upon transfer from the auxiliary platform to the new pallet, it is essential that the latter be positioned with great precision relative to the auxiliary platform prior to the retraction thereof at the smallest possible distance beneath the auxiliary platform. This positioning precision requires that the height of the pallet be taken into consideration, and for this purpose, it is known to provide a photocell system for measuring the height of each new pallet.

This measuring method has not been found to be fully satisfactory because of the nature of the pallets and the fact that the pallet may carry a wrapping or protective paper underlay for the stack or may have portions at different levels, for example because a nail may project above the receiving surface of the pallet. Indeed, in many instances the variation in level of the pallet may not be detrimental, except in the case of the transfer of the temporary stack from the auxiliary platform to the pallet.

For example, the protective paper may project above the receiving surface and, although it is not a problem with respect to the receipt of the temporary stack, will give a false indication of the pallet height on measurement by a photocell and thus result in an excessive drop of the temporary stack upon the transfer. In cases in which a nail or the like of narrow dimension may project above the surface of the pallet, it frequently will not be registered by the photocell. For this and other reasons, photocell-measurement systems have been found to be unsatisfactory in many cases.

OBJECTS OF THE INVENTION

It is, therefore, the principal object of the present invention to provide an improved stacking apparatus, whereby these drawbacks will be avoided.

Another object of this invention is to provide a stacking apparatus with an improved pallet-height measuring system which will not respond to insignificant factors such as an upwardly-projecting piece of protective paper on the pallet, but will be responsive to upwardly-projecting nails and like structures to which photocell systems may not have been responsive in the past.

It is also an object of the invention to provide an improved stacking apparatus which is capable of determining the pallet height with great reliability and such that a reliable transfer of the intermediate stack from the auxiliary-stacking platform to the new pallet is possible

SUMMARY OF THE INVENTION

These objects and others which will become apparent hereinafter are attained, in accordance with the invention, in a stacking apparatus which comprises:

an upright support;

means for continuously feeding sheets to be stacked to the support;

a pallet-receiving platform mounted on the support and raisable thereon into a sheet-receiving position for deposition of the sheets on a pallet disposed on the platform and lowerable on the support as sheets are deposited on a stack forming on the pallet;

an auxiliary stacking platform positionable on the support to receive the sheets upon lowering of the pallet-receiving platform for a pallet change, whereby the auxiliary stacking platform accumulates a stack of the sheets during the pallet change, the stack on the auxiliary stacking platform being transferred to a pallet newly disposed upon the pallet-receiving platform after a pallet change and approaching of the platforms to one another; and a pallet-height detector on the support, the pallet-height detector comprising:

a sensing element dimensioned and positioned to sweep across an entire sheet-receiving surface of the pallets upon relative movement of the pallets and the detector, the sensing element being deflectable upwardly upon engagement with the surface, and means operatively connected to the sensing element for detecting a maximum deflection of the sensing element caused by engagement of the element by the surface.

With the system of the invention, the pallet height is detected by a sensing element or skid which scans or rides over the entire upper surface of the pallet and is urged thereagainst at least in part by its own weight and, therefore, can mechanically press down nondetrimental projecting structures, such as the protective paper, so that they do not register as far as the height of the pallet is concerned. However, nails or the like, which cannot be pressed down and which project above the surface, are registered by the sensing element or skid and thus are measured as contributing to the height, thereby ensuring the effective transfer of the intermediate stack to the pallet.

According to a feature of the invention, the skid extends across the entire surface of the pallet and is swingably supported by a pair of arms or levers at the ends of the skid on the upright support.

The sensing element can be disposed at a location along the path of the pallet which is fixed relative to the displacement of the pallet, i.e. along the pallet-feed means. Thus the pallet height can be determined during transport of a new pallet to the pallet-receiving platform. The measurement of the vertical deflection of the skid is preferably effected by operatively connecting the skid to a rack meshing with a pinion which is provided with an angle coder.

The skid is applied, according to the invention, with an adjustable force or pressure to the upper surface of the pallet, e.g. via fluid-operated cylinders which can be connected to the swingable levers on which the skid is supported. The adjustable or variable forces with which the skid is applied to the pallet allows matching of the force to the potentially detrimental and nondetrimental projections above the surface. The piston-and-cylinder units may be double-acting units to permit variation of the forces.

BRIEF DESCRIPTION OF THE DRAWING

The above and other objects, features and advantages of the present invention will become more readily apparent from the following description, reference being made to the accompanying drawing in which.

DESCRIPTION

The upright support of the stacking apparatus of the invention comprises four stands or posts, 1, 2, between which a pallet-receiving platform 3 is raisable and lowerable, e.g. with cable and pulleys represented at 40 and 41, respectively.

Figure 1:
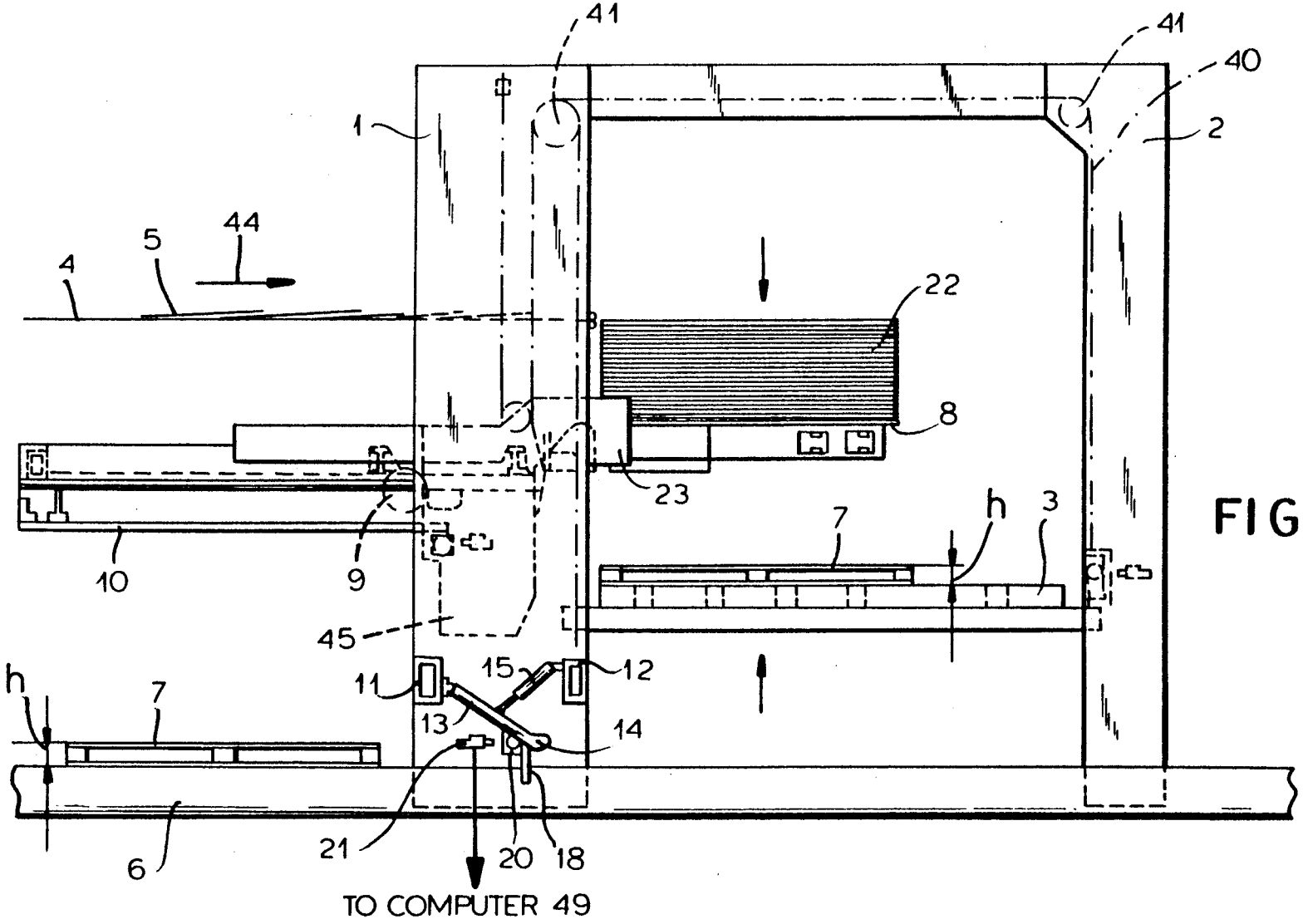
FIG. 1 is a side elevational view taken transversely to the direction of movement of the sheets of a sheet-stacking apparatus, according to the invention.

The pallet-receiving platform 3 can be lifted into the region of a delivery plane 4 representing the means for feeding sheets or signatures 5 to the apparatus and can be lowered to the bottom thereof in which the platform can lie flush with a pallet-feed conveyor system represented diagrammatically at 6 in FIG. 1. The platform 3 and the conveyer 6 may be-formed as roller or wheel conveyors as represented at 42 in FIG. 3. The conveyors serve to deliver the pallet 7 in the direction of arrow 43 which corresponds to the direction 44 of sheet transport.

At the inlet side posts 1, an auxiliary stacking platform 8 is mounted and can be raised and lowered on a carriage 45, not shown in detail, to receive an intermediate stack 22 of the sheets. The auxiliary platform 8 can be shifted horizontally via a drive 9 on a guide 10 which permits insertion of the auxiliary platform 8 between the sheet-delivery plane 4 and the platform 3 (see FIG. 1) and retraction of the platform 8 to deposit the intermediate stack 22 upon a pallet 7 disposed on the platform 3.

Figure 2:
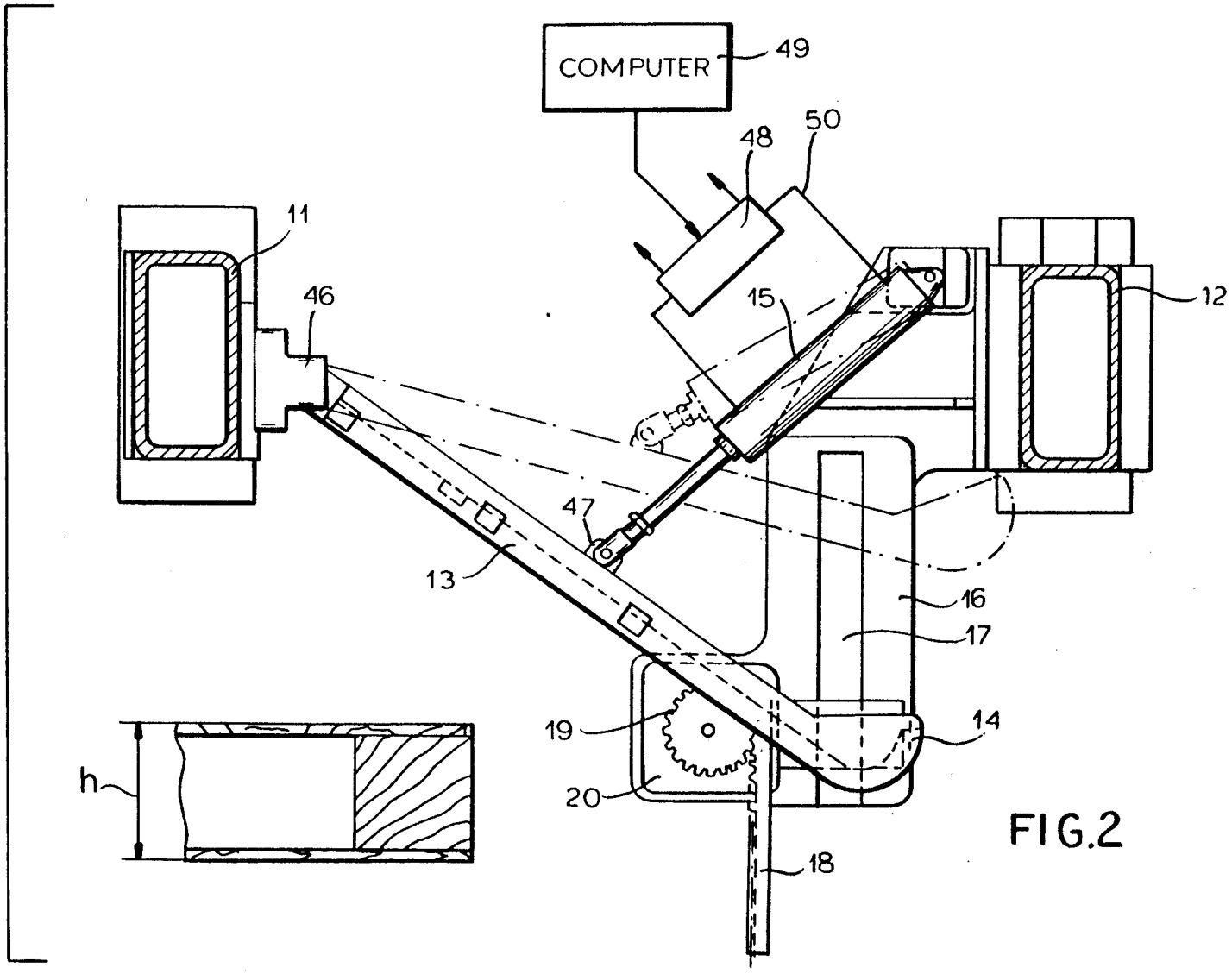
FIG. 2 is an enlarged section of a portion of FIG. 1 showing the device for determining the pallet height.

Consequently, the sheets 5 can be stacked on the auxiliary platform 8 while a full stack is transported away, e.g. to the right in FIG. 2, and a new pallet 7 supplied by the conveyor 6 is transferred to the platform 3. Upon retraction of the auxiliary pallet 8, it lies to the left of the frame 1, 2 as described, for example, in German patent 37 39 194.

Figure 3:
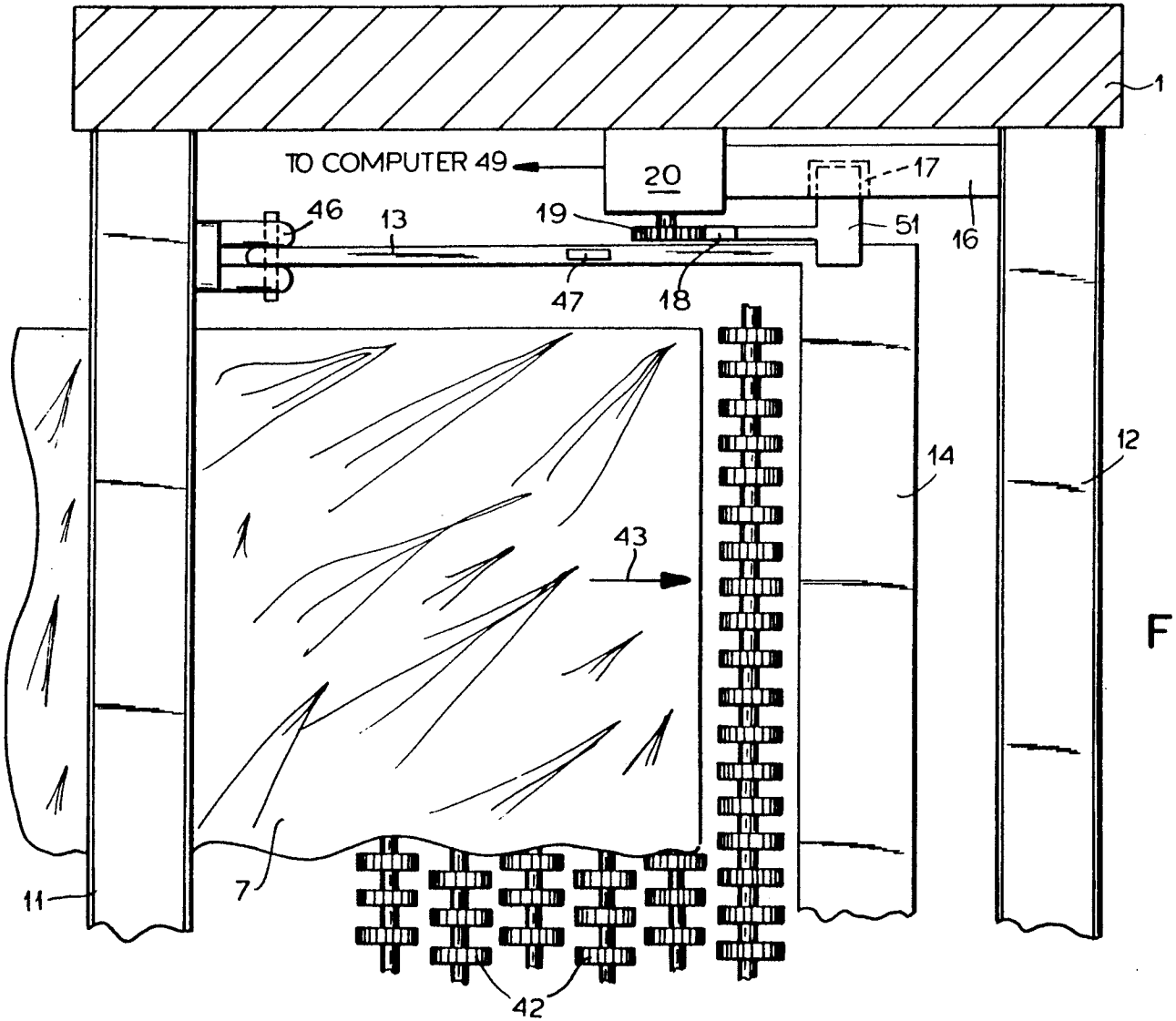
FIG. 3 is a fragmentary plan view of one side of the skid forming part of the latter device.

Between the two inlet side posts 1, according to the invention, a device is provided for measuring the pallet height, this device being shown in greater detail in FIGS. 2 and 3.

Below the guide 10 for the auxiliary platform 8 and above the platen-feed conveyor 6, two traverses 11 and 12 bridge the posts 1 at the same height and across the full working width (see FIG. 3).

On the front traverse 11, two swingable levers 13 are pivotally mounted at 46, one of these levers being visible in FIG. 1 while the other is seen in FIG. 3. The free ends of these levers are bridged by a skid 14 which extends the full working width of the pallet 7 so that the skid 14 can ride over the entire upper surface thereof as the pallet is displaced past the skid 14.

The lengths of the levers 13 and their positions are so selected that the skid 14 can be lowered approximately to the bottom of the skid and hence the upper skid of the conveyor 6 and can be raised, through say 80 mm, to a location above the maximum height of a pallet 7 and thus can ride on the pallet 7 to be lifted thereby by a distance equal to the height h thereof.

Raising and lowering of the skid 14 is effected by two double-acting piston-and-cylinder units 15 which are pivotally mounted laterally on the rear traverse 12 and each of which is pivotally connected at 47 to an articulation on the respective lever 13. The double-acting cylinder 15 for the lever 13 shown in FIGS. 3 has been omitted to better illustrate the measurement elements outputting the height h.

For adjustment of the force with which the skid 14 rests upon the pallet 7, the downwardly effective force is controllable with a fine-control valve diagrammatically shown at 48 forming part of a hydraulic system 50 and controlled by a computer 49 represented diagrammatically in FIG. 2.

Outside the working width, on one side and upon the traverse 12, a lateral shield 16 is provided which has a vertical guide 17 in which a member 51 engaged by the skid 14 can ride. The member 51 may be guided horizontally in a slot of the skid 14 not shown so that it is entrained by the skid vertically but is restricted from horizontal movement by the guide 17*. Member 51 operatively connects the skid 14 with a vertical rack 18 meshing with a pinion 19 connected by an angle coder 20. The angle coder 20, whose output is supplied to the computer 49, thus registers the vertical deflection of the skid as a pallet 7 passes thereunder.

2nd instance

As the empty pallet 7 passes the measuring device in its travel to the platform 3, therefore, its maximum height h is measured and stored in the computer. Upstream of the skid 14, a photocell detector or light curtain 21 is provided and has an output to the computer 49 as well.

The photocell 21 thus can detect the leading edge of a pallet 7 so that the computer 49 can operate the hydraulic system 50 to reduce the pressure holding the skid 14 at an upper position via the piston-and-cylinder units 15, whereby the skid 14 lowers as a result of its weight and comes to rest upon the upper surface of the pallet. The skid 14 senses the upper surface of the pallet as the pallet travels past the skid so that the angle coder 20 will output a signal representing the vertical deflection of the skid. The maximum value of the vertical deflection is stored as the height h of the pallet is the weight of the skid 14, as controlled by the cylinder units 15 and acting upon the pallet is adjusted such that nondetrimental projects above the surface, e.g. from wrapping paper thereon, can be folded down and thus are not registered as contributions to the height. Potentially detrimental projections above the surface, like projecting nails, are registered because they deflect the skid upwardly.

The stored maximum height of the pallet 7 provides an input to the computer which controls the rise of the platform 3 with the pallet 7 thereon to position this pallet 7 immediately below the platform 8. So that the delivery of sheets 5 is not interrupted during a stack-change operation, the intermediate stack 22 is formed on this platform 8 until a full stack on the platform 3 is transported away and a new pallet 7 whose height has been measured, is raised below the receiving surface of the pallet 6.

During this intermediate stacking, of course, the auxiliary platform 8 is continuously lowered so that the surface of the intermediate stack receiving the oncoming sheets remains approximately at the level of the delivery plane.

While the stack is held back, the platform 8 is retracted to the left to deposit this stack upon the new pallet which is held with precision at a fixed minimum distance, about 10 mm for example, below the platform 8. Since the height measurement has taken into consideration solid projections such as projecting nails, a collision of the raised pallet 7 with the auxiliary platform 8 is avoided with great reliability. The transfer of the intermediate stack is thus effected without problems caused by nondetrimental projections above the surface like those which would be created by folded wrapping paper. As a consequence, an excessive drop of the intermediate stack 22 onto the pallet 7 can be avoided.

The movement of a new pallet 7 toward the underside of the platform 8 is so controlled that an inductive proximity switch 23 provides a reference point for the computer of the proximity of the platform 3 when the pallet 7 is still sufficiently distant from the auxiliary platform 8 to allow the height measurement to control the remaining movement. The reduction of the distance of the pallet from the platform 8 to a point that the platform 3 is located at a distance below the platform 8 equal to the height h plus 10 mm, is obtained by fine control of the rise of the platform 3. The platforms 3 and 8 can also have angle coders which input the respective positions to the computer 49.

In the embodiment illustrated, the sensing element (skid 14) is horizontally fixed with respect to the movement of the pallet 7. It is also possible, in accordance with the invention, to hold the pallet stationary while the skid 14 is displaced thereagainst. In that case, the traverses 11 and 12 can form parts of a horizontally displaceable carriage, movable between the posts 1, 2. This sensor must then be moved out of the path of the rising platform 3.

We claim:

1. An apparatus for stacking sheets, comprising:

an upright support;

means for continuously feeding sheets to be stacked to said support;

a pallet-receiving platform mounted on said support and raisable thereon into a sheet-receiving position for deposition of said sheets on a pallet disposed on said platform and lowerable on said support as sheets are deposited on a stack forming on said pallet;

an auxilliary stacking platform positionable on said support to receive said sheets upon lowering of said pallet-receiving platform for a pallet change, whereby said auxiliary stacking platform accumulates a stack of said sheets during said pallet change, said stack on said auxiliary stacking platform being transferred to a pallet newly disposed upon said pallet-receiving platform after a pallet change and approaching of said platforms to one another;

a pallet-height detector on said support, said pallet-height detector comprising;

a sensing element dimensioned and positioned to sweep across an entire sheet-receiving surface of said pallets upon relative movement of said pallets and said detector, said sensing element being deflectable upwardly upon engagement with said surface, and means operatively connected to said sensing element for detecting a maximum deflection of said sensing element caused by engagement of said element by said surface; and proximity detecting means responsive to approach of said pallet-receiving platform to said auxiliary stacking platform to enable control of the position of said surface as a function of said detected maximum deflection.

2. The apparatus defined in claim 1 wherein said element is a skid adapted to ride on said surface.

3. The apparatus defined in claim 2 wherein said skid extends a full width of said surface of said pallets and has a pair of swingable levers connected to the skid at opposite ends of said skid.

4. The apparatus defined in claim 2 wherein said skid extends horizontally and is connected to said support at a fixed location thereon and detects said height as said pallets are displaced past said skid.

5. The apparatus defined in claim 2, further comprising means for controlling a force with which said element bears upon said surface.

6. The apparatus defined in claim 5 wherein said means for controlling said force with which said element bears upon said surface includes a double-acting fluid cylinder.

7. The apparatus defined in claim 6 wherein said skid extends a full width of said surface of said pallets and has a pair of swingable levers connected to the skid at opposite ends of said skid.

8. The apparatus defined in claim 9 wherein said skid extends horizontally and is connected to said support at a fixed location thereon and detects said height as said pallets are displaced past said skid.

9. An apparatus for stacking sheets, comprising:

an upright support;

means for continuously feeding sheets to be stacked to said support;

a pallet-receiving platform mounted on said support and raisable thereon into a sheet-receiving position for deposition of said sheets on a pallet disposed on said platform and lowerable on said support as sheets are deposited on a stack forming on said pallet;

an auxiliary stacking platform positionable on said support to receive said sheets upon lowering of said pallet-receiving platform for a pallet change, whereby said auxiliary stacking platform accumulates a stack of said sheets during said pallet change, said stack on said auxiliary stacking platform being transferred to a pallet newly disposed upon said pallet-receiving platform after a pallet change and approaching of said platforms to one another;

a pallet-height detector on said support, said pallet-height detector comprising:

a sensing element dimensioned and positioned to sweep across an entire sheet-receiving surface of said pallets upon relative movement of said pallets and said detector and in the form of a skid adapted to ride on said surface, said sensing element being deflectable upwardly upon engagement with said surface, and means operatively connected to said sensing element for detecting a maximum deflection of said sensing element caused by engagement of said element by said surface, means for controlling a force with which said element bears upon said surface, said means for controlling said force with which said element bears upon said surface including a double-acting fluid cylinder, said skid extending a full width of said surface and said pallets and having a pair of swingable levers connected to the skid at opposite ends of said skid. said skid extending horizontally and being connected to said support at a fixed location thereon and detecting said height as said pallets are displaced past said skid, said means operatively connected to said sensing element for detecting a maximum deflection of said sensing element caused by engagement of said element by said surface including a rack operatively connected to said skid for movement of said rack vertically upon deflection of said skid by said surface, a pinion meshing with said rack and disposed at a fixed location of said support, and an angle coder coupled to said pinion.

10. An apparatus for stacking sheets, comprising:

an upright support;

means for continuously feeding sheets to be stacked to said support;

a pallet-receiving platform mounted on said support and raisable thereon into a sheet-receiving position for deposition of said sheets on a pallet disposed on said platform and lowerable on said support as sheets are deposited on a stack forming on said pallet;

an auxiliary stacking platform positionable on said support to receive said sheets upon lowering of said pallet-receiving platform for a pallet change, whereby said auxiliary stacking platform accumulates a stack of said sheets during said pallet change, said stack on said auxiliary stacking platform being transferred to a pallet newly disposed upon said pallet-receiving platform after a pallet change and approaching of said platforms to one another; and a pallet-height detector on said support, said pallet-height detector comprising:

a sensing element dimensioned and positioned to sweep across an entire sheet-receiving surface of said pallets upon relative movement of said pallets and said detector and in the form of a skid adapted to ride on said surface, said sensing element being deflectable upwardly upon engagement with said surface, and means operatively connected to said sensing element for detecting a maximum deflection of said sensing element caused by engagement of said element by said surface, said means operatively connected to said sensing element for detecting a maximum deflection of said sensing element caused by engagement of said element by said surface including a rack operatively connected to said skid for movement of said rack vertically upon deflection of said skid by said surface, a pinion meshing with said rack and disposed at a fixed location of said support, and an angle coder coupled to said pinion.

* * * * *